US009022801B2

(12) United States Patent
Endo et al.

(10) Patent No.: US 9,022,801 B2
(45) Date of Patent: May 5, 2015

(54) ELECTRIC CONNECTOR

(71) Applicant: Dai-Ichi Seiko Co., Ltd., Kyoto (JP)

(72) Inventors: Takayoshi Endo, Shizuoka (JP); Sakai Yagi, Shizuoka (JP); Masaya Muta, Shizuoka (JP); Shunya Oohashi, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 39 days.

(21) Appl. No.: 13/971,024

(22) Filed: Aug. 20, 2013

(65) Prior Publication Data

US 2014/0057486 A1 Feb. 27, 2014

(30) Foreign Application Priority Data

Aug. 21, 2012 (JP) ..... 2012-182753

(51) Int. Cl.

| | |
|---|---|
| ***H01R 13/193*** | (2006.01) |
| ***H01R 13/533*** | (2006.01) |
| ***H01R 13/422*** | (2006.01) |
| *H01R 12/91* | (2011.01) |
| *H01R 13/11* | (2006.01) |

(52) U.S. Cl.

CPC ..... *H01R 13/533* (2013.01); *H01R 12/91* (2013.01); *H01R 13/114* (2013.01); *H01R 13/4223* (2013.01)

(58) Field of Classification Search

CPC ..... H01R 13/4223; H01R 13/4365; H01R 13/4364; H01R 13/193

USPC ..... 439/595, 246

See application file for complete search history.

(56) References Cited

U.S. PATENT DOCUMENTS

| | | | | |
|---|---|---|---|---|
| 3,397,384 | A * | 8/1968 | Lawrence | 439/246 |
| 3,808,589 | A | 4/1974 | Bonhomme | |
| 4,558,912 | A * | 12/1985 | Coller et al. | 439/246 |
| 4,778,404 | A * | 10/1988 | Pass | 439/387 |
| 5,611,717 | A | 3/1997 | Joly | |
| 6,315,591 | B2 * | 11/2001 | Oda et al. | 439/252 |
| 7,140,895 | B2 * | 11/2006 | Tuin et al. | 439/246 |
| 7,658,645 | B1 | 2/2010 | Morello et al. | |
| 8,747,157 | B2 * | 6/2014 | Tashiro | 439/595 |
| 2004/0002259 | A1 | 1/2004 | Fukatsu et al. | |
| 2004/0180576 | A1 * | 9/2004 | Hasebe | 439/595 |

(Continued)

FOREIGN PATENT DOCUMENTS

| | | |
|---|---|---|
| DE | 199 18 326 | 10/2000 |
| DE | 10 2010 011 371 | 9/2011 |
| EP | 0 678 936 | 10/1995 |
| EP | 1 376 769 | 1/2004 |
| JP | 4-81470 | 7/1992 |
| JP | 5-55468 | 7/1993 |
| JP | 2595483 | 3/1999 |
| JP | 2013-84505 | 5/2013 |
| WO | 2012/035030 | 3/2012 |

OTHER PUBLICATIONS

European Search Report (ESR) issued Oct. 17, 2013 in corresponding European Patent Application No. EP 13 18 0078.

*Primary Examiner* — Gary Paumen

(74) *Attorney, Agent, or Firm* — Wenderoth, Lind & Ponack, L.L.P.

(57) ABSTRACT

An electric connector includes at least one connector terminal into which a male connector terminal of a male electric connector is inserted, and a housing including a terminal storage room in which the connector terminal is housed. The housing includes a support supporting the connector terminal at at least one of an outer surface and a bottom of the connector terminal when the male connector terminal is inserted into the terminal storage room for preventing the connector terminal from inclining.

10 Claims, 20 Drawing Sheets

(56) References Cited

U.S. PATENT DOCUMENTS

2005/0048824 A1* 3/2005 Horikoshi et al. ..... 439/246
2005/0090149 A1* 4/2005 Fukatsu et al. ..... 439/595
2013/0065410 A1 3/2013 Nehm et al.
2013/0065436 A1* 3/2013 Hirabayashi et al. ..... 439/595
2013/0171892 A1 7/2013 Hachadorian

* cited by examiner

ELECTRIC CONNECTOR

BACKGROUND OF THE INVENTION

1. Field of the Invention

The invention relates to an electric connector including a connector terminal having a pair of spring terminals between which a male connector terminal of a male electric connector is sandwiched, and further to a housing of a female electric connector to be used in the above-mentioned electric connector.

2. Description of the Related Art

A connector terminal into which a male connector terminal of a male electric connector is inserted is used for electrically connecting printed circuit boards to each other or connecting a cable to a printed circuit board.

An example of such a connector terminal is disclosed in Japanese Utility Model No. 2595483, for instance.

FIG. 20 is a front view of the electric connector disclosed in the above-identified Japanese Utility Model.

The electric connector illustrated in FIG. 20 includes a female contact 2 and a male contact 3. The female contact 2 includes a contact 2A into which the male contact 3 is fit, a base 2B fixed on a body 1, and a leg 4 extending upwardly from the body 1 and connecting the body 1 to an upper end of the contact 2A. The leg 4 is composed of an electrically conductive material, and acts as a spring. The base 2B is formed at a surface thereof with a projection 5 to prevent the contact 2A from being excessively compressed downwardly.

Since the electric connector is designed to include the projection 5 formed at a surface of the base 2B, the projection 5 supports the contact 2A through a bottom of the contact 2A when the male contact 3 is deflected to thereby cause the contact 2A to be expanded, and prevents the contact 2A from excessively lowering. Thus, the electric connector can be designed to have a small height with the contact 2A being in a floating condition.

However, the conventional electric connector illustrated in FIG. 20 is accompanied with a problem that after the contact 2A is lowered to make abutment at a bottom thereof with the base 2B, a portion of the contact 2A located at the opposite side of the leg 4 is outwardly inclined, resulting in that a contact pressure between the contact 2A and the male contact 3 is avoidably reduced, and hence, contact reliability between the contact 2A and the male contact 3 is deteriorated. In particular, if the male contact 3 were fit into the contact 2A in a deflected condition, a contact pressure to the male contact 3 is reduced, and further, the male contact 3 and/or the contact 2A may be buckled.

A positional relation between the male contact 3 and the contact 2A may be deflected even after the male contact 3 is fit into the contact 2A. In particular, in an electric connector equipped in an automobile, a positional relation between a printed circuit board on which a female electric connector is mounted and a printed circuit board on which a male electric connector is mounted is prone to be deflected due to vibration generated while an automobile is running and/or a difference between the printed circuit boards in thermal expansion caused by temperature fluctuation around the printed circuit boards. Though the deflection in the positional relation can be cancelled when one of housings is fit into the other, there is generated deflection in clearances of the housings. Thus, since each time a male contact moves when an automobile vibrates, it is important for a female contact to provide contact reliability in electrical connection with the male contact.

SUMMARY OF THE INVENTION

In view of the above-mentioned problems in the conventional connectors, it is an object of the present invention to provide an electric connector capable of avoiding reduction in contact reliability between male and female connectors, even if the male connector is fit into the female connector in a deflected condition, or even if the male connector is deflected relative to the female connector after the male connector were fit into the female connector. It is further an object of the present invention to provide a housing of a female electric connector to be used in the above-mentioned electric connector.

In one aspect of the present invention, an electric connector includes at least one connector terminal into which a male connector terminal of a male electric connector is inserted, and a housing including a terminal storage room in which the connector terminal is housed. The housing includes a support supporting the connector terminal at at least one of an outer surface and a bottom of the connector terminal when the male connector terminal is inserted into the terminal storage room for preventing the connector terminal from inclining.

In the above-mentioned electric connector in accordance with the present invention, when a male connector terminal is inserted into the connector terminal, the support supports the connector terminal at an outer surface and/or a bottom of the connector terminal to thereby prevent the connector terminal from inclining. Thus, it is possible to prevent reduction in contact reliability to a male connector terminal caused by inclination of the connector terminal. In the specification, the term "when the male connector terminal is inserted into the connector terminal" means both an instant at which the male connector terminal is inserted into the connector terminal and a case in which the male connector terminal is kept inserted in the connector terminal.

It is preferable that the support extends from an inner wall of the terminal storage room, and makes abutment at a distal end thereof with an outer surface of the connector terminal.

By so designing the support, it is possible to prevent the connector terminal from inclining.

It is preferable that the support includes, at a distal end thereof, an abutment surface through which the support makes contact with an outer surface of the connector terminal.

By designing the support to include the abutment surface, the abutment surface can make surface contact at corners of the support with an outer surface of the connector terminal to thereby prevent a tension force from concentrating to the corners of the support, and thus, preventing the corners of the support from being damaged.

It is preferable that the support makes abutment with an outer surface of the connector terminal in an inclined condition.

By so designing the support, even if the male connector terminal deflects towards the support when the male connector terminal is inserted into the connector terminal, the support moves in a direction in which the support causes an inner wall of the terminal storage room to be closed, and thus, the support is able to support an outer surface of the connector terminal such that the connector terminal is upwardly pushed.

It is preferable that the connector terminal includes a projection with which a distal end of the support makes engagement.

By causing the support to make engagement at a distal end thereof with the projection, the support is able to make abutment at a distal end thereof with the connector terminal at a target point when the connector terminal inclines.

It is preferable that the projection has an inclined surface extending from the connector terminal at an acute angle relative to a direction in which the male connector terminal is inserted into the connector terminal, and has a distal end having an inclined surface with which the support makes abutment, the inclined surface inclining relative to the direction at 90 degrees or an obtuse angle.

By so designing the projection and the support, it is possible for the support to make engagement with the projection without interfering with the projection, when the connector terminal is inserted into a housing.

It is preferable that the support has an abutment surface through which the support makes abutment with the inclined surface of the projection.

By designing the support to have the above-mentioned abutment surface, the abutment surface can surely make abutment with the inclined surface of the projection, ensuring it is difficult for the support at a distal end thereof to release from the inclined surface of the projection.

It is preferable that the connector terminal includes a terminal main body and a connector portion, the terminal main body including a first spring portion making contact with the male connector terminal, a first spring support portion supporting the first spring portion, a second spring portion making contact with the male connector terminal, a second spring support portion supporting the second spring portion, and a space-limiter limiting expansion of a space between the first spring portion and the second spring support portion, the connector portion being formed at the first spring support portion, the support supporting the second spring support portion.

When a male connector terminal moves towards the second spring portion, the first spring portion is caused to move towards the second spring portion together with the second spring support portion by the space-limiter. Thus, the terminal main body is caused to move as the male connector terminal moves. However, since the support supports the second spring support portion, the terminal main body cannot move beyond the support, ensuring that a contact pressure exerted by the first and second spring portions to a male connector terminal is maintained.

It is preferable that the space-limiter comprises a joint portion connecting a side of the first spring portion with a side of the second spring support portion.

By designing the space-limiter to comprise such a joint portion, even if a male connector terminal were deflected to thereby compress the second spring portion to expand a space between the first and second spring portions, a space between the first and second spring portions is kept constant by means of the joint portion, preventing the first and second spring portions from being spaced away from each other.

It is preferable that the space-limiter includes a joint portion connecting a lower end of the first spring portion with a lower end of the second spring support portion, and a stepped portion extending over the first spring portion, the joint portion and the second spring support portion.

The stepped portion ensures enhancement in rigidity of the first spring portion, the joint portion and the second spring support portion. Hence, even if a male connector terminal were deflected to thereby compress the second spring portion to expand a space between the first and second spring portions, it is possible to prevent the first and second spring portions from being spaced away from each other.

It is preferable that the support is made of an elastically deformable material.

In another aspect of the present invention, there is provided a housing of an electric connector, including a terminal storage room in which a connector terminal into which a male connector terminal of a male electric connector is inserted is housed, and a support supporting the connector terminal at at least one of an outer surface and a bottom of the connector terminal when the male connector terminal is inserted into the terminal storage room for preventing the connector terminal from inclining.

It is preferable that the support extends from an inner wall of the terminal storage room, and makes abutment at a distal end thereof with an outer surface of the connector terminal.

It is preferable that the support includes at a distal end thereof an abutment surface through which the support makes contact with an outer surface of the connector terminal.

It is preferable that the support makes abutment with an outer surface of the connector terminal in an inclined condition.

It is preferable that the support has an inclined abutment surface at a distal end thereof.

It is preferable that the support is made of an elastically deformable material.

The advantages obtained by the aforementioned present invention will be described hereinbelow.

Both of the electric connector and the housing in accordance with the present invention prevent the connector terminal from inclining. Thus, in case a male connector is fit into the connector terminal in a deflected condition, or in case a male connector is deflected relative to the connector terminal after the male connector fits into the connector terminal, it would be possible to avoid reduction in contact reliability between a male connector and the connector terminal.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

A female electric connector in accordance with the first embodiment of the present invention is explained hereinbelow with reference to the drawings.

In the specification, a male connector terminal of a male electric connector is inserted into a printed circuit board located "below" the male connector terminal.

Figure 1:
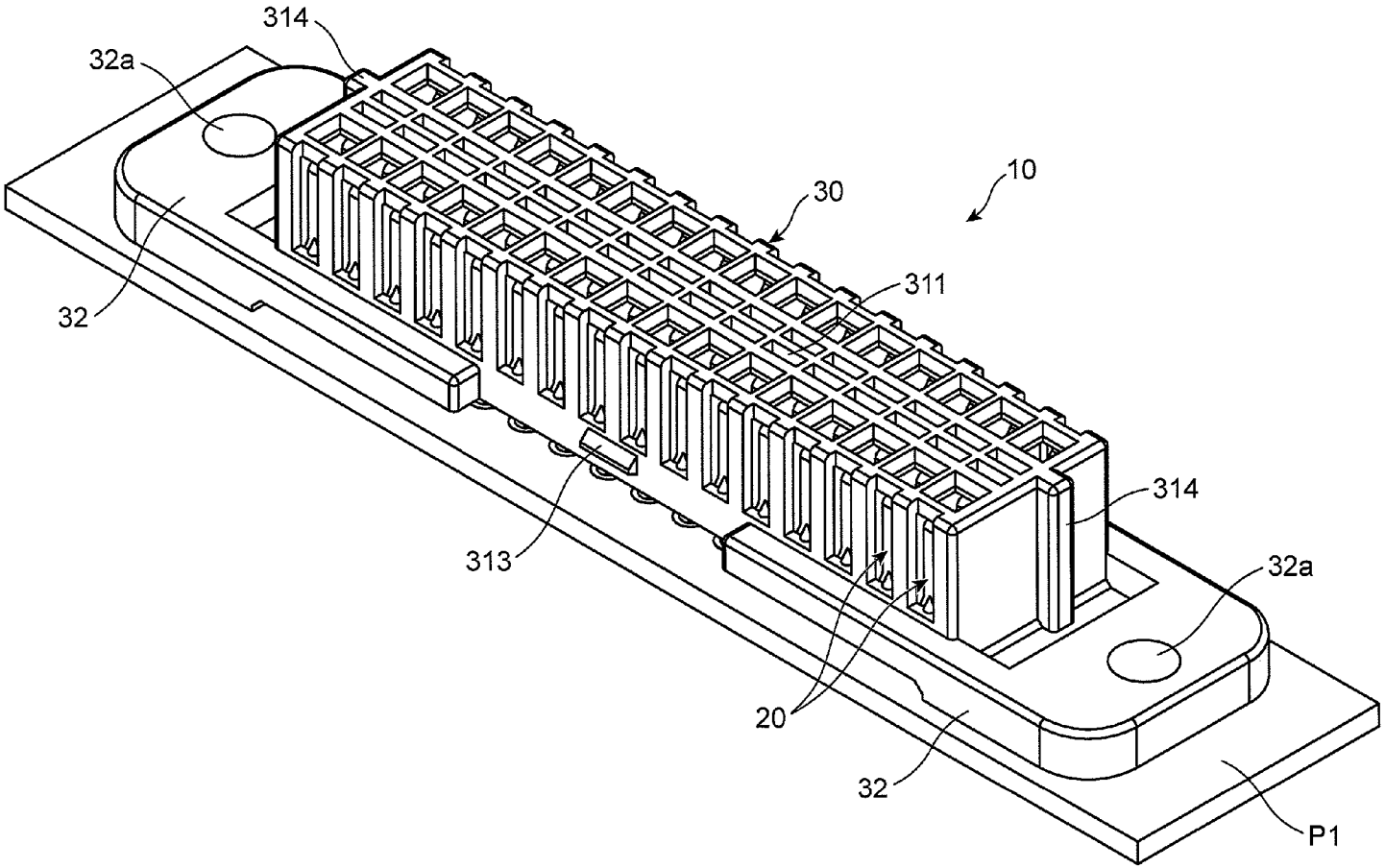
FIG. 1 is a perspective view of the female electric connector in accordance with the first embodiment of the present invention, being mounted on a printed circuit board.
Figure 2:
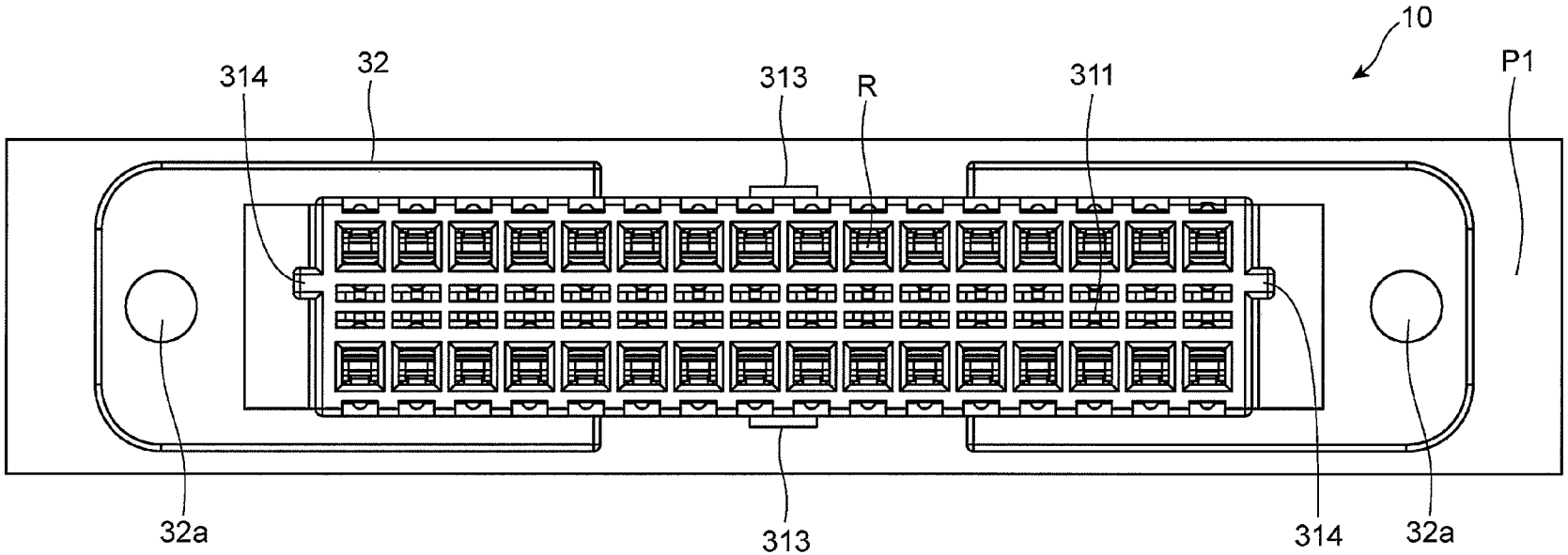
FIG. 2 is a plan view of the electric connector illustrated in FIG. 1.
Figure 3:
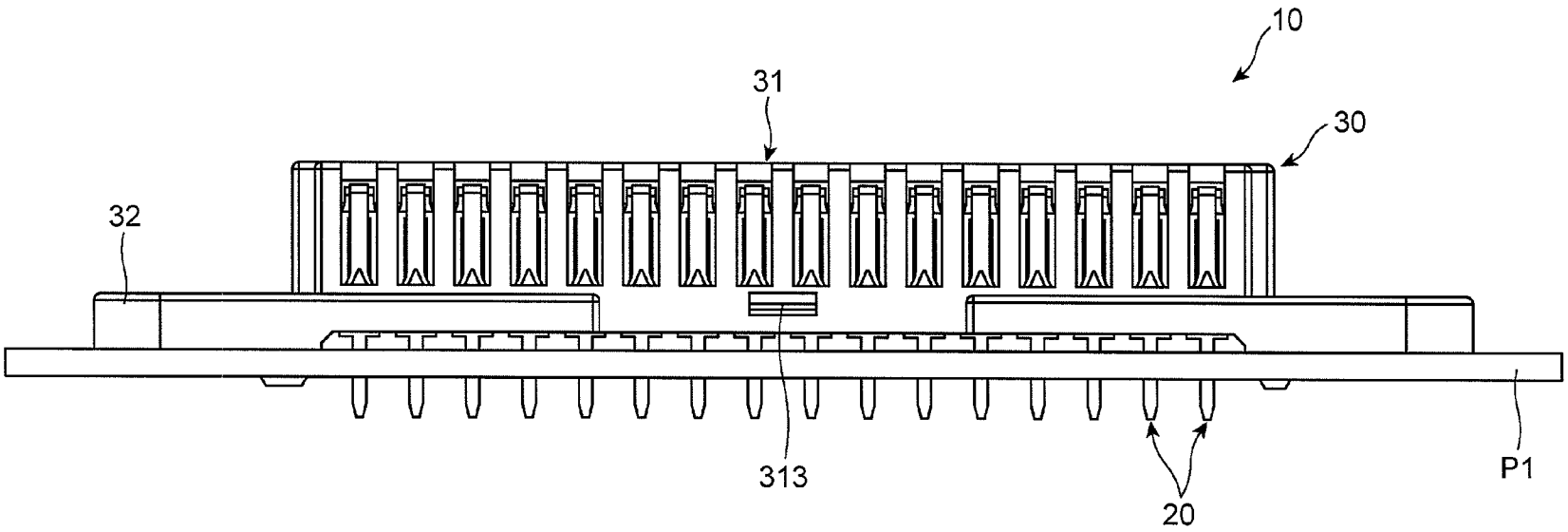
FIG. 3 is a front view of the electric connector illustrated in FIG. 1.
Figure 10:
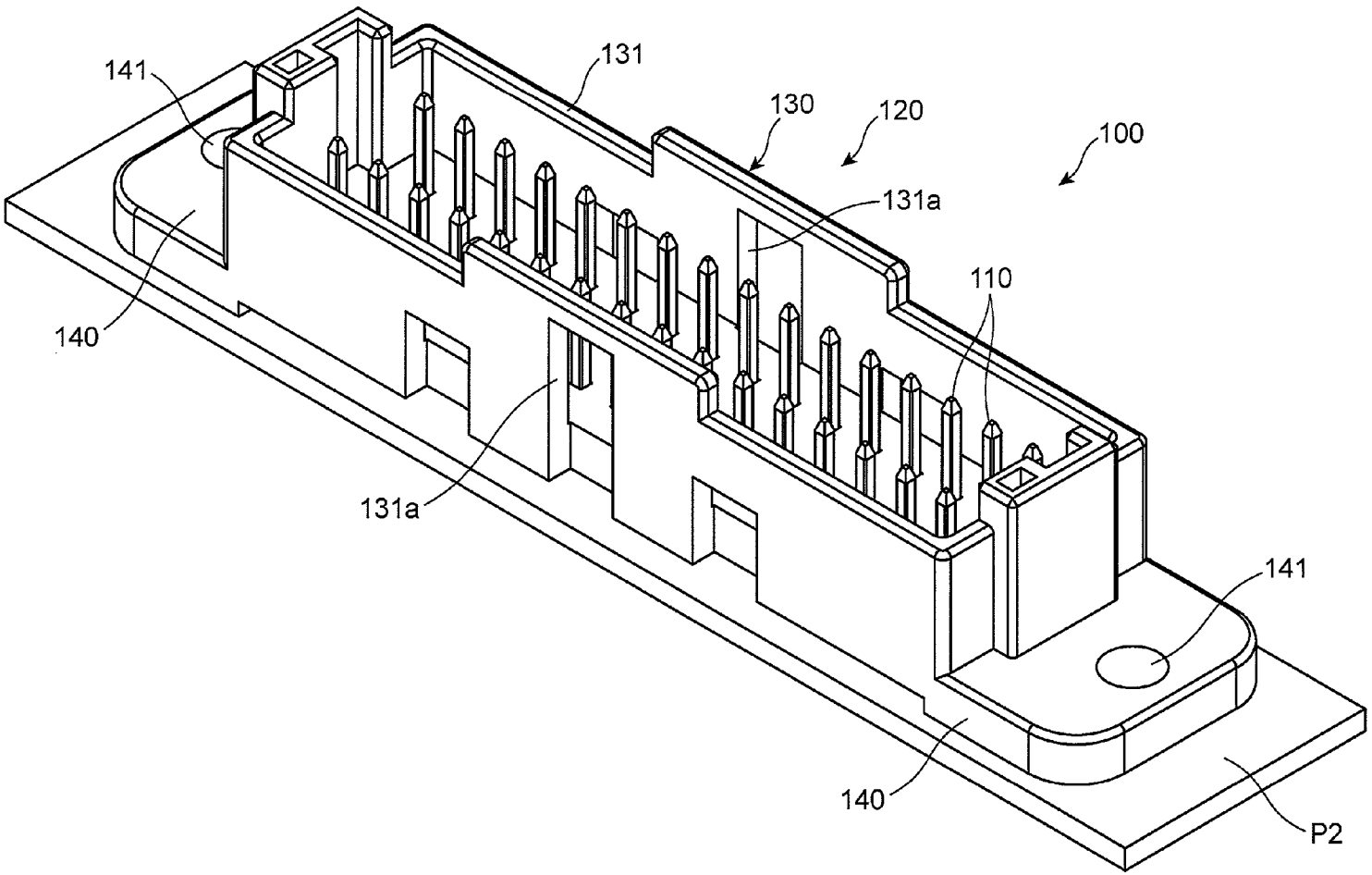
FIG. 10 is a perspective view of the male electric connector to be fit into the electric connector illustrated in FIG. 1, being mounted on a printed circuit board.
Figure 11:
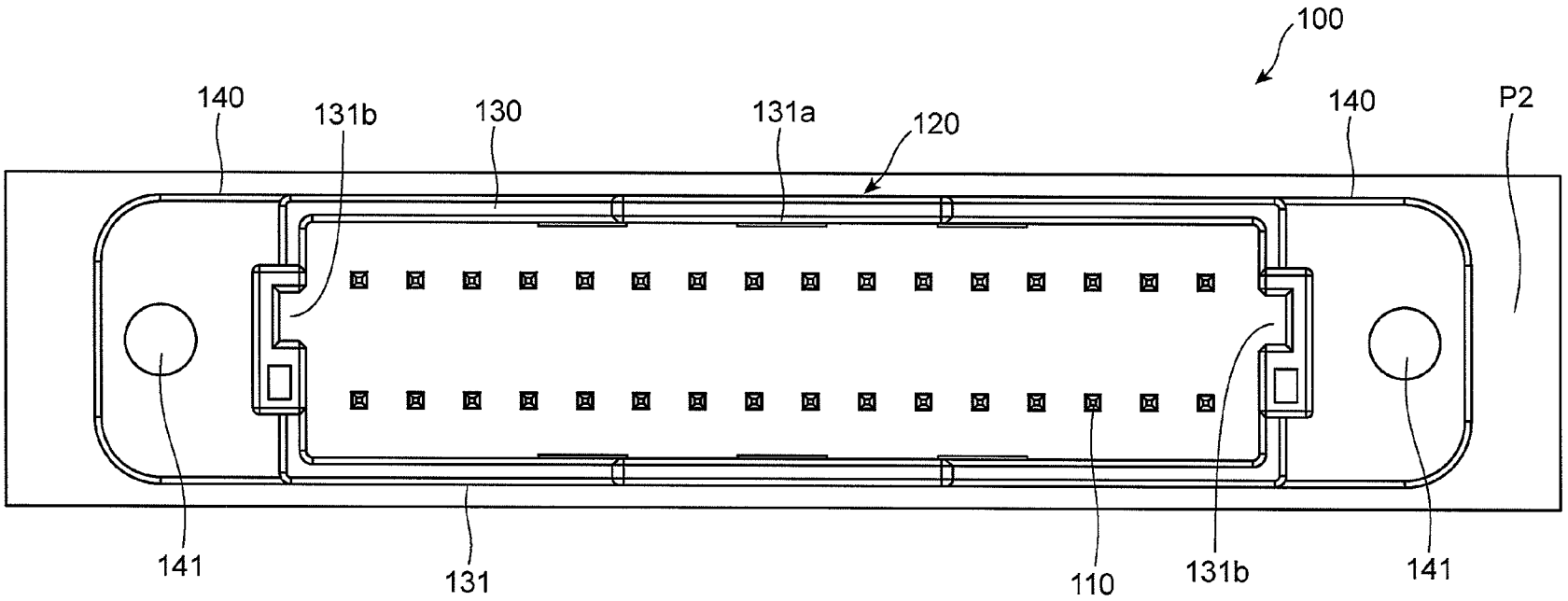
FIG. 11 is a plan view of the electric connector illustrated in FIG. 10.
Figure 12:
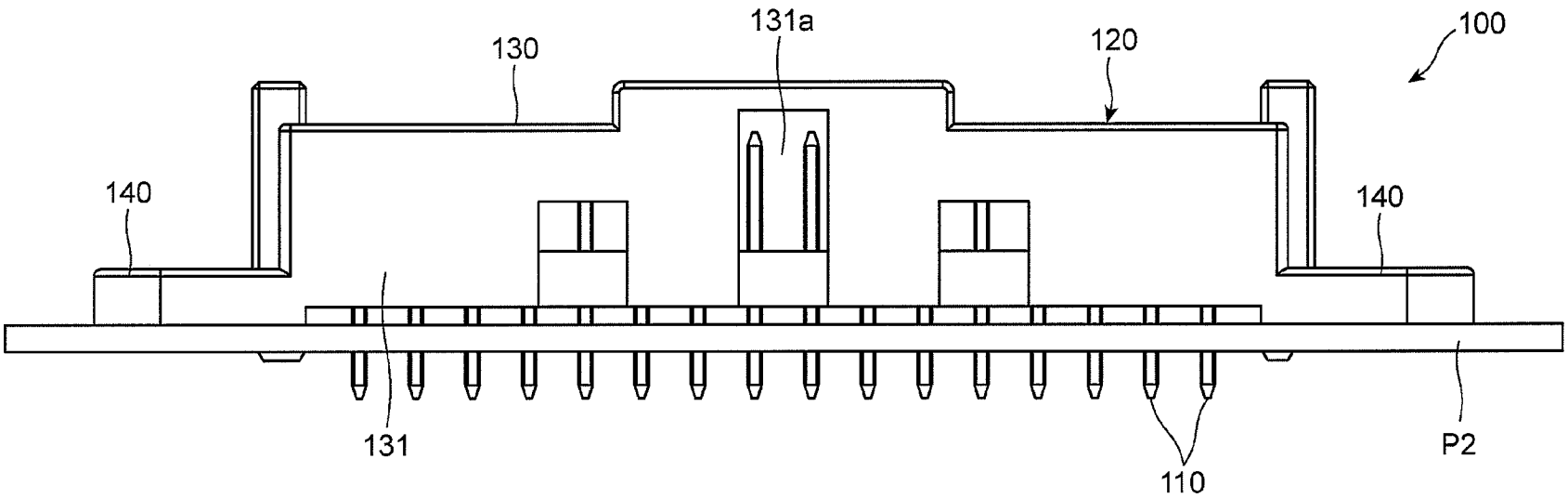
FIG. 12 is a front view of the electric connector illustrated in FIG. 10.

As illustrated in FIGS. 1 to 3, the electric connector 10 in accordance with the first embodiment is mounted on a printed circuit board P1 (a circuit board to be equipped in an automobile), and is fit into a male electric connector 100 mounted on a printed circuit board P2, illustrated in FIGS. 10 to 12, to thereby electrically connect the printed circuit boards P1 and P2 to each other.

The electric connector 10 includes a plurality of connector terminals 20, and a housing 30.

The connector terminal 20 illustrated in FIGS. 4 to 7 is formed by punching a single metal plate, and bending the same.

The connector terminal 20 is inserted through a bottom thereof into a terminal storage room R formed in the housing 30. The connector terminal 20 includes a terminal main body 20*a* sandwiching therein a male connector terminal 110 (see FIG. 9) of the male electric connector 100, and a connector portion 20*b* supporting the terminal main body 20*a* and fixing the terminal main body 20*a* to the printed circuit board P1.

The terminal main body 20*a* includes a first spring terminal 21, a second spring terminal 22, and a joint portion 23 connecting the first and second spring terminals 21 and 22 to each other.

The first spring terminal 21 includes a first spring portion 211 making contact with one side of the male connector terminal 110, and a first spring support portion 212 supporting the first spring portion 211.

The second spring terminal 22 includes a second spring portion 221 making contact with the other side of the male connector terminal 110, and a second spring support portion 222 supporting the second spring portion 221.

The first spring portion 211 has a structure of a flat spring, and suspends from a resilient portion 212*a* located at a distal end of the first spring support portion 212. The first spring portion 211 is formed at a contact surface thereof with two substantially rectangular projections 211*b*. The projections 211*b* are formed by beading.

The first spring support portion 212 has a width-increased portion 212*b* in the vicinity of a proximal end closer to the printed circuit board P1. A width of the first spring support portion 212 gradually decreases towards a distal end from the width-increased portion 212*b*, and the first spring support portion 212 is connected at a distal end thereof to the resilient portion 212*a*. The width-increased portion 212*b* is formed at sides thereof with sawtooth-shaped projections (not illustrated) which make engagement with sidewalls of the terminal storage room R of the housing 30. The resilient portion 212*a* is designed to have a width smaller than the same of the width-increased portion 212*b* so as to be able to readily resiliently deform, similarly to a distal end of the first spring support portion 212.

The first spring support portion 212 is formed at an outer surface (opposite side relative to the first spring portion 211) with a substantially triangular projection 212*c* making engagement with a later-mentioned raised portion of the housing 30. The projection 212*c* is formed by pressing, including a step of cutting a bottom of the triangle.

The second spring portion 221 is disposed facing the first spring portion 211 such that there is formed a space S between the first spring portion 211 and the second spring portion 212, into which the male connector terminal 110 of the male electric connector 100 is inserted. The second spring portion 221 is designed to have almost the same width as that of the second spring support portion 222, and downwardly extends from a bending portion 222*a* located at a top end of the second spring support portion 222 to thereby make contact with the other side of the male connector terminal 110. The second spring portion 221 has a structure of a flat spring. The second spring portion 221 is formed at a distal end thereof with a contact 221*a* formed by bending the metal plate substantially V-shaped.

The second spring support portion 222 is formed at an outer surface thereof (a rear surface located opposite to the second spring portion 221) with a substantially triangular projection 222*b* making abutment with a later-mentioned lance portion 311*a* (see FIG. 9) of the housing 30 to thereby prevent a space between the first and second spring terminals 21 and 22 from expanding. The projection 222*b* can be formed by pressing, including a step of cutting a bottom of the triangle.

Figure 9:
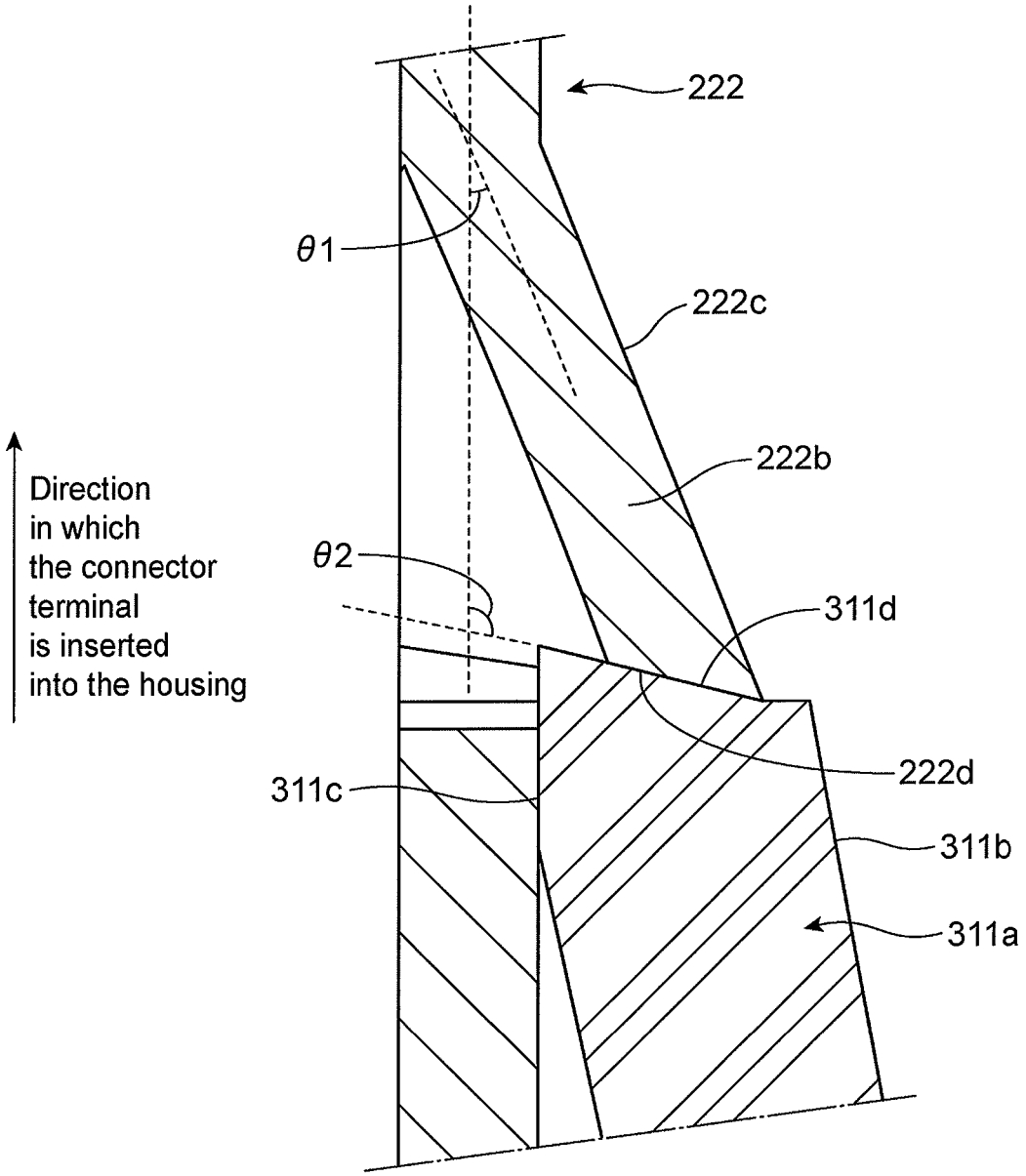
FIG. 9 is a partially enlarged view of the engagement of the second spring support portion with the lance portion.

As illustrated in FIG. 9, the projection 222*b* is designed to have an inclined surface 222*c* extending at an acute angle ($\theta_1$ in FIG. 9) relative to a rear surface of the second spring support portion 222 in a direction in which the connector terminal 20 is inserted into the housing 30, and further have an inclined top surface 222*d* with which the lance portion 311*a* makes engagement and which forms an obtuse angle ($\theta_2$ in FIG. 9) relative to a rear surface of the second spring support portion 222 in a direction in which the connector terminal 20 is inserted into the housing 30.

As illustrated in FIGS. 4 to 7, the joint portion 23 acts as a space-limiter restricting a space between the first spring portion 211 and the second spring support portion 222. The joint portion 23 connects a side of the first spring portion 211 to a side of the second spring support portion 222, wherein the sides extend in a direction in which the male connector terminal 110 is inserted into and pulled out of the space S.

The connector portion 20*b* is in the form of a needle such that it can be readily inserted into the printed circuit board P1. The connector portion 20*b* is connected to a proximal end of the first spring support portion 212 of the terminal main body 20*a*.

The housing 30 illustrated in FIGS. 1 to 3 is substantially rectangular, when viewed vertically, and includes a housing main body 31 in which the terminal storage rooms R into each of which the connector terminal 20 is housed are formed in a matrix, and a pair of flanges 32 outwardly extending from opposite ends of the housing main body 31 in a length-wise direction of the housing main body 31.

Figure 8:
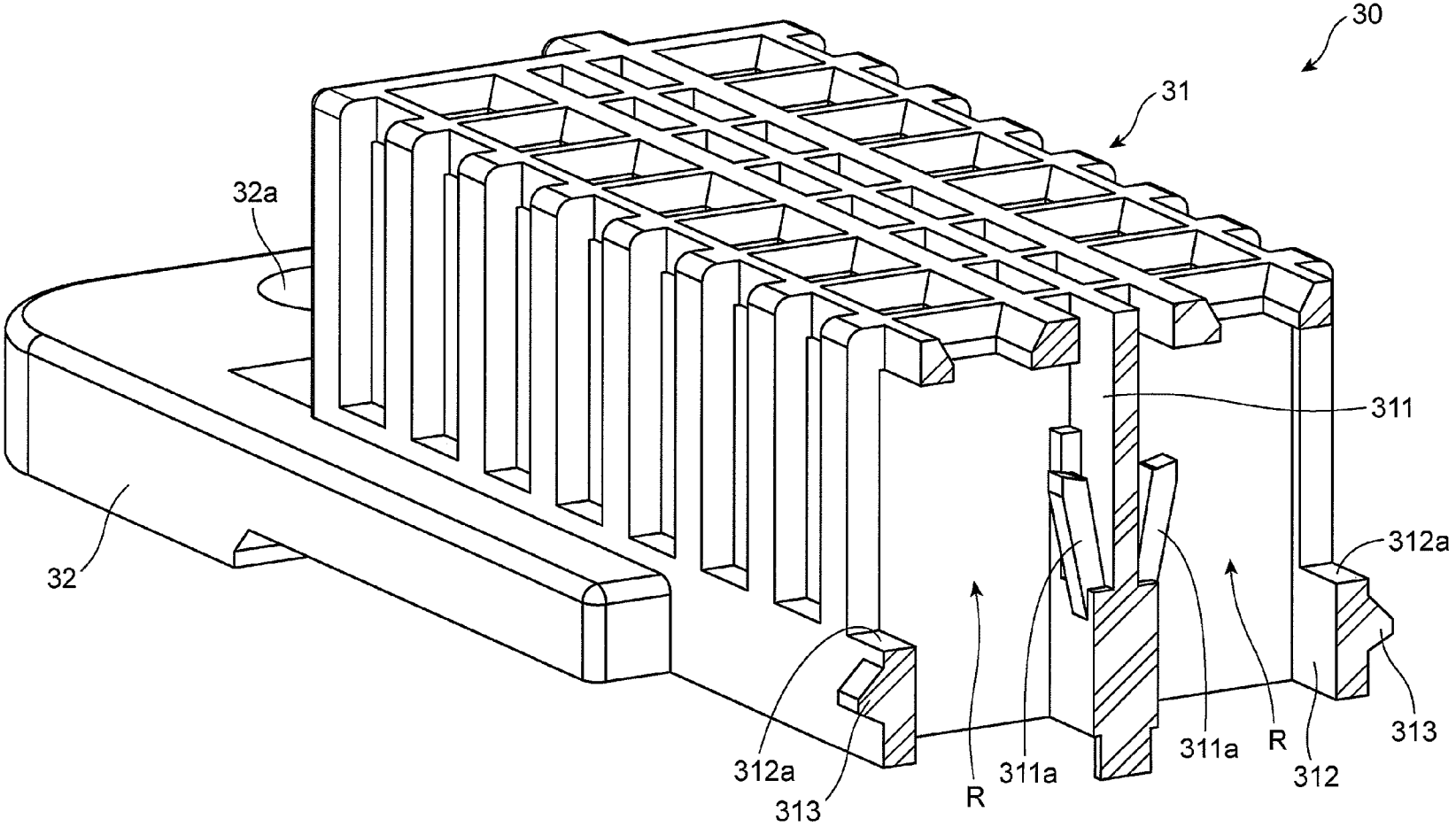
FIG. 8 is a cross-sectional view of a housing of the electric connector illustrated in FIG. 1.

As illustrated in FIG. 8, the housing main body 31 is formed with a partition wall 311, an inner wall, separating two rows of the terminal storage rooms R from each other, aligned in a length-wise direction of the housing main body 31. A pair of lance portions 311*a* extends from opposite surfaces of the partition wall 311. Each of the lance portions 311*a* acts as a support with which the projection 222*b* of the second spring support portion 222 illustrated in FIG. 4 makes engagement. Since the connector terminal 20 is inserted into the terminal storage room R through a bottom of the terminal storage room R, and the second spring support portion 222 inclines in such a direction that an upper portion of the second spring support portion 222 outwardly inclines about a bottom thereof, the lance portions 311*a* obliquely upwardly extends towards an upper portion of the second spring support portion 222 from a bottom of the partition wall 311.

Figure 14:
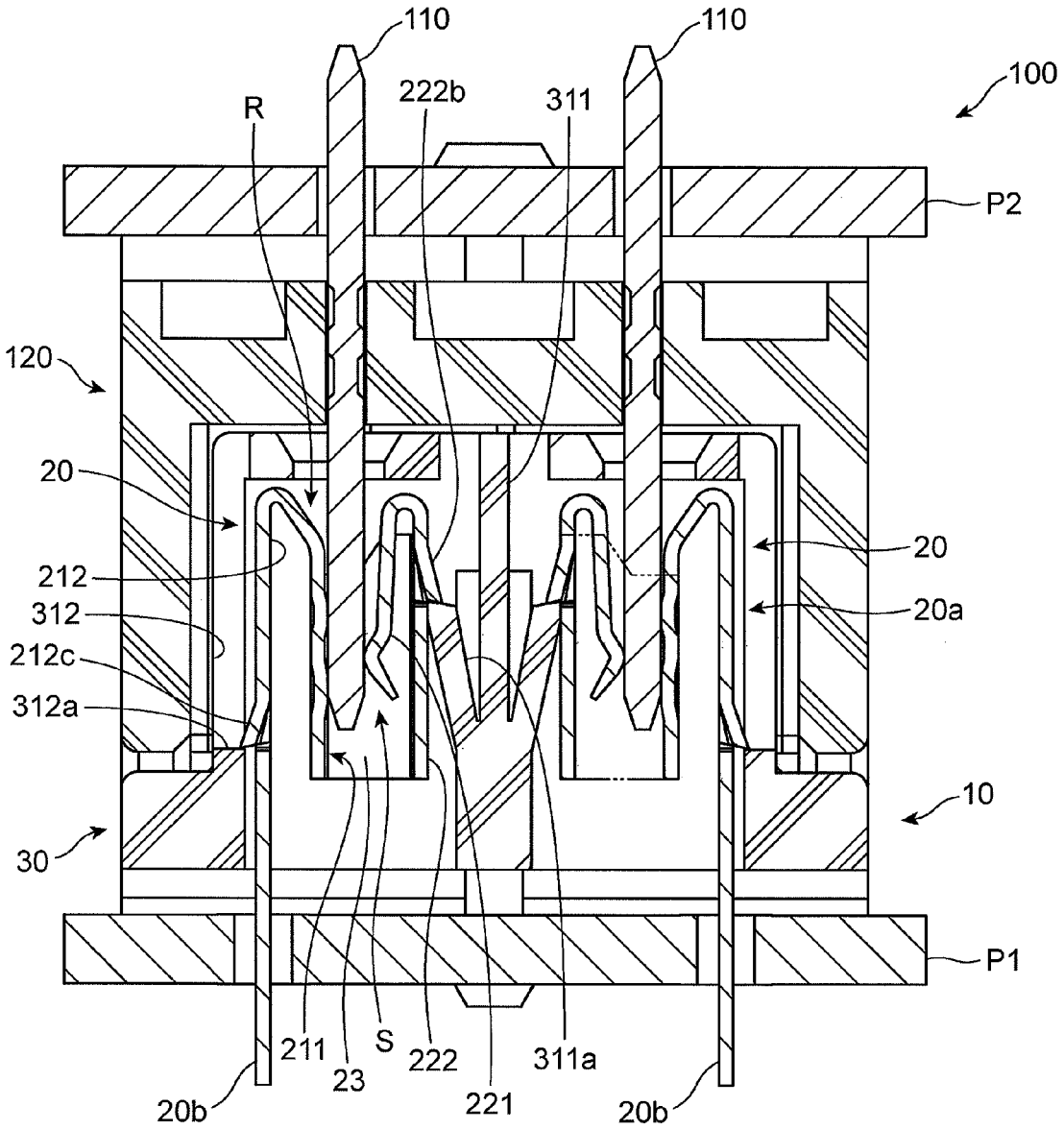
FIG. 14 is a cross-sectional view of the female and male electric connectors illustrated in FIG. 13 being fit with each other.

As illustrated in FIGS. 8 and 14, the housing main body 31 is formed with pedestals 312*a* extending from inner walls 312 facing the partition wall 311. Each of the pedestals 312*a* acts as a projection with which the projection 212*c* of the first spring support portion 212 makes engagement. Furthermore, the housing main body 31 is formed with engagement projections 313 and raised portions 314 (see FIG. 1) with both of which a housing of the male electric connector 100 makes engagement, when the housing main body 31 and the housing of the male electric connector 100 are fit to each other.

Each of the flanges 32 is formed with a through-hole 32*a* through which the printed circuit board P1 is fixed by means of a fixing unit.

Hereinbelow, the lance portion 311*a* is explained in detail with reference to FIG. 9.

The lance portion 311*a* is elastically deformable in the form of a pillar. The lance portion 311*a* is formed at a top portion 311*b* thereof with a first abutment surface 311*c* with which the second spring support portion 222, a rear surface of the terminal main body 20*a*, makes surface contact. It is preferable that the first abutment surface 311*c* is substantially in parallel with a rear surface of the second spring support portion 222.

The lance portion 311*a* is formed at a top portion 311*b* thereof with a second abutment surface 311*d* making engagement with the inclined surface 222*d* of the projection 222*b* to thereby make surface contact with the inclined surface 222*d*. It is preferable that the second abutment surface 311*d* has an inclination angle almost equal to the same of the inclined surface 222*d* of the projection 222*b*, in which case, the second abutment surface 311*d* can make abutment with the inclined surface 222*d* without a gap therebetween.

When the connector terminal 20 is inserted into the terminal storage room R, the lance portion 311*a* mounts on the inclined surface 222*c* of the projection 222*b* as the connector terminal 20 goes into the terminal storage room R, and thus, the second spring support portion 222 is elastically deformed in such a direction that the second spring support portion 222 is closed, that is, the second spring support portion 222 moves towards the first spring portion 211. When the projection 222*b* moves beyond the lance portion 311*a*, the second spring support portion 222 returns to its original shape, and hence, the lance portion 311*a* makes abutment at the second abutment surface 311*d* thereof with the inclined surface 222*d* of the projection 222*b*, and further, at the first abutment surface 311*c* thereof with a rear surface of the second spring support portion 222.

The inclined surface 222*c* of the projection 222*b* extends from the second spring support portion 222 at an acute angle ($\theta_1$ in FIG. 9) relative to a direction in which the male connector terminal 110 is inserted into the connector terminal 20, and the inclined surface 222*d* with which the lance portion 311*a* makes abutment inclines at 90 degrees or an obtuse angle ($\theta_2$ in FIG. 9) relative to the above-mentioned direction. Thus, when the connector terminal 20 is inserted into the housing 30, the projection 222*b* can surely make abutment with the lance portion 311*a* without interfering with the lance portion 311*a*.

The electric connector 100 mounted on the printed circuit board P2 is explained hereinbelow with reference to the drawings.

As illustrated in FIGS. 10 to 12, the electric connector 100 includes a plurality of needle-shaped male connector terminals 110 having one end to be inserted into and fixed in the printed circuit board P2 and the other end to be inserted into the connector terminal 20 (see FIG. 1) of the electric connector 10, and a housing 120 into which the housing 30 of the electric connector 10 is inserted and fit.

The housing 120 includes a housing main body 130 which is in the form of a box having a bottom, and is open for fitting with the housing 30 of the electric connector 10, and further, in which a plurality of the male connector terminals 110 are fixed in a matrix, and flanges 140 outwardly extending from opposite ends of the housing main body 130 in a length-wise direction of the housing main body 130.

The housing main body 130 is formed at a peripheral wall 131 thereof with engagement openings 131*a* and recesses 131*b* into which the engagement projections 313 and 314 of the housing 30 of the male electric connector 10 are fit, respectively. Since the engagement between the engagement projection 313 and the engagement opening 131*a*, and the engagement between the engagement projection 314 and the recess 131*b* are designed to be a fitting with play (so-called free fit), the electric connectors 10 and 100 are able to slightly move relative to each other. Each of the flanges 140 is formed with a through-hole 141 through which the flange 140 is fixed to the printed circuit board P2 by means of a fixing unit.

The electric connector 10 in accordance with the first embodiment of the present invention, having the above-mentioned structure, is used as follows.

Figure 13:
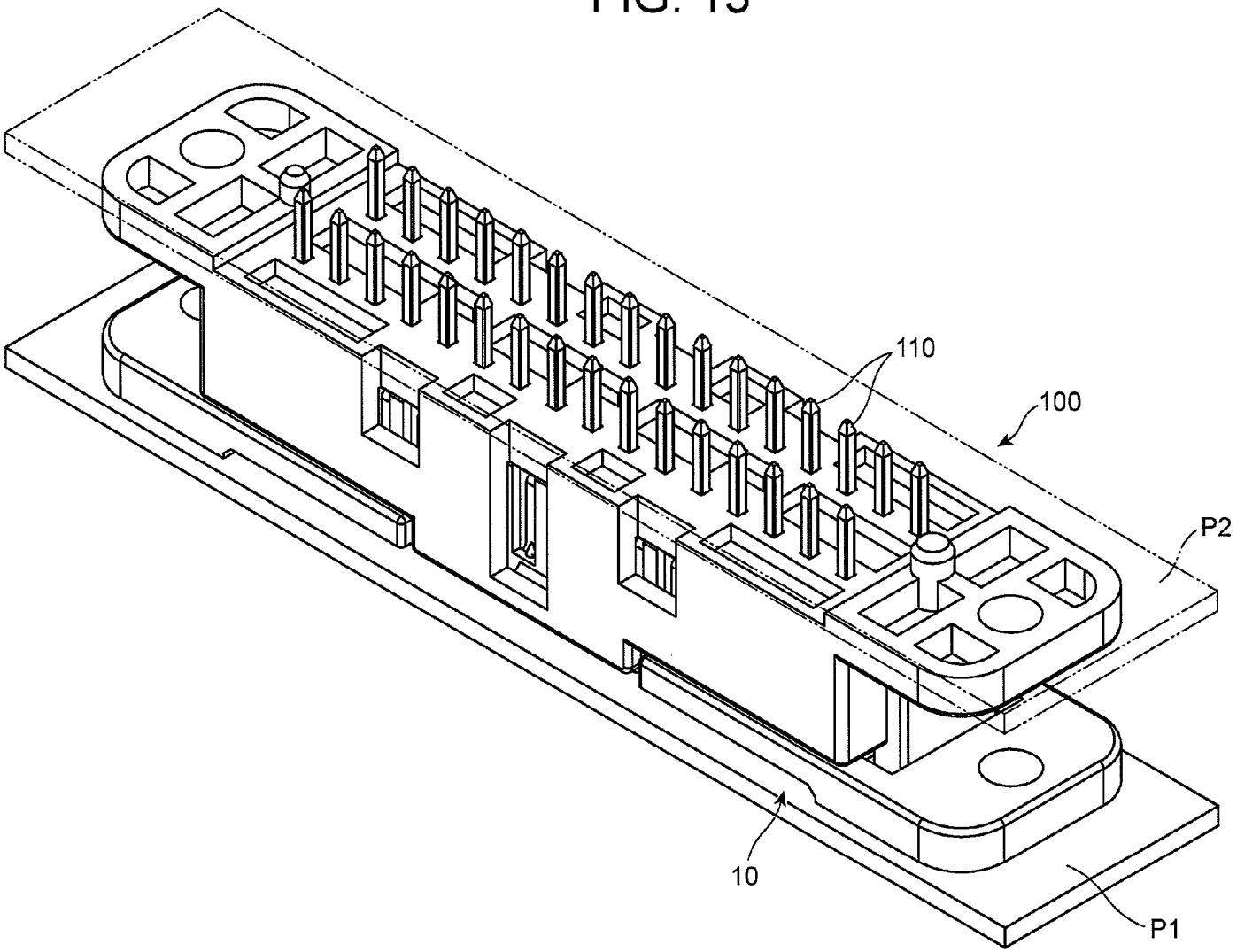
FIG. 13 is a perspective view of the female electric connector illustrated in FIG. 1 and the male electric connector illustrated in FIG. 10 being fit with each other.

As illustrated in FIGS. 13 and 14, the male electric connector 100 mounted on the printed circuit board P2 is coupled to the female electric connector 10 mounted on the printed circuit board P1. Each of the male connector terminals 110 arranged in the housing 120 of the electric connector 100 is inserted into an insertion space S of the connector terminal 20.

Being inserted into the connector terminal 20, the male connector terminal 110 makes contact at one side thereof with the first spring portion 211 and at the other side thereof with the second spring portion 221. The male connector terminal 110 deeply enters the connector terminal 20, making sliding contact with the connector terminal 20.

Herein, it is supposed that the male connector terminal 110 is inserted into the connector terminal 20 with a positional relation between the printed circuit boards P1 and P2 being deflected, or that after the male connector terminal 110 has been inserted into the connector terminal 20, a positional relation between the printed circuit boards P1 and P2 is deflected due to oscillation, and hence, the male connector terminal 110 now being inserted into the connector terminal 20 inclines.

Figure 15:
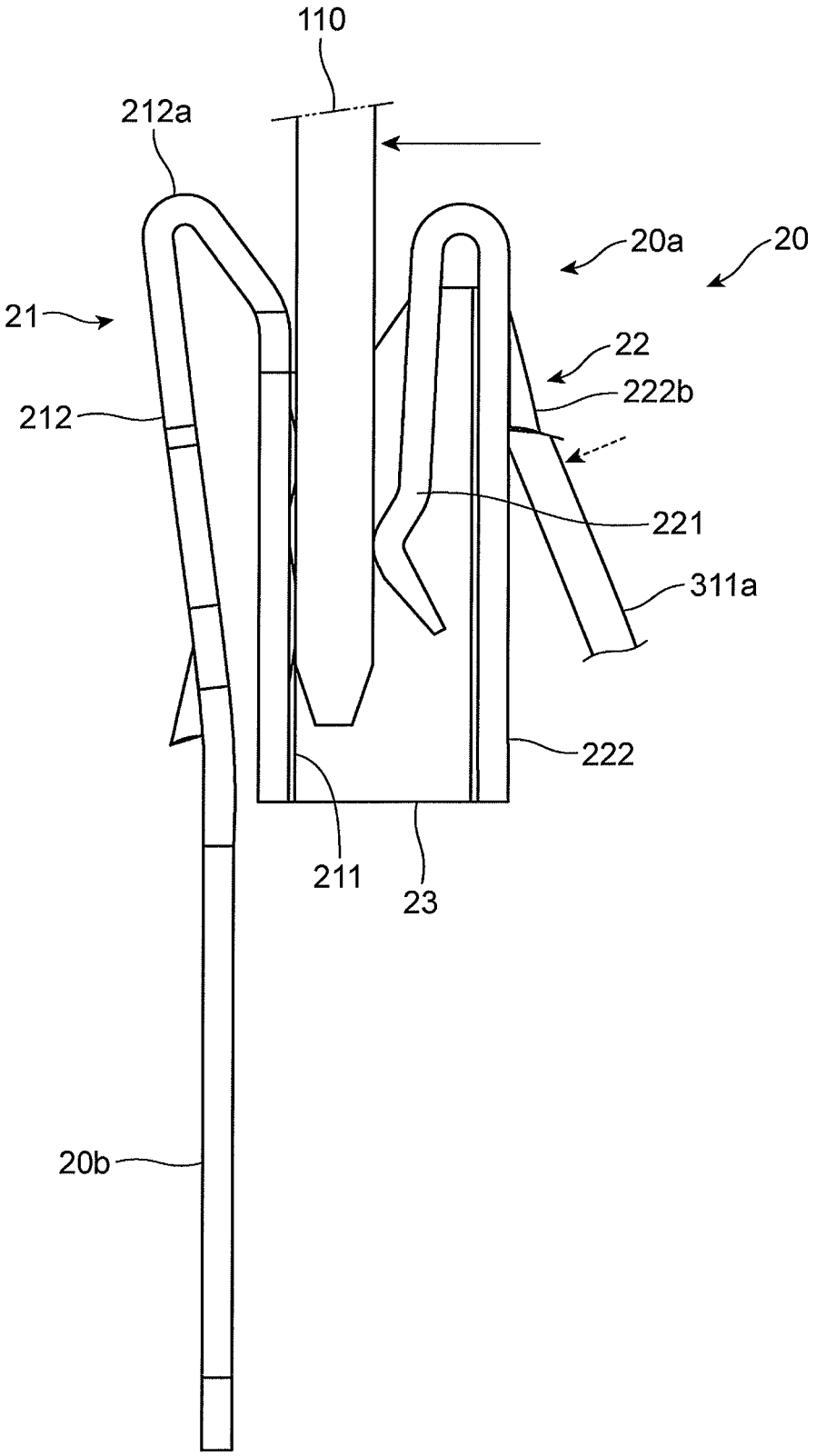
FIG. 15 illustrates that a male connector terminal inserted into the connector terminal illustrated in FIG. 10 horizontally deflects toward the first spring portion.

For instance, if the male connector terminal 110 deflects towards the first spring portion 211, as illustrated in FIG. 15, the first spring portion 211 is compressed due to the deflection of the male connector terminal 110, and thus, a space between the first spring portion 211 and the second spring portion 221 is caused to expand. However, since the first spring portion 211 and the second spring support portion 222 are connected at sides thereof to each other through the joint portion 23, the joint portion 23 acts as a space-limiter to prohibit a space between the first spring portion 211 and the second spring support portion 222 from expanding, and hence, the second spring support portion 222 is drawn towards the first spring portion 211 by the joint portion 23.

Consequently, it is possible to move the first spring portion 211 and the second spring portion 221 to a position to which the male connector terminal 110 has moved, since the resilient portion 212*a* located at a distal end of the first spring support portion 212 connected to the connector portion 20*b* is resiliently closed, maintaining a contact between the terminal main body 21 and the male connector terminal 110. Thus, since a space between the first spring portion 211 and the second spring portion 221 is kept constant, it is possible to maintain a contact pressure which the second spring portion 221 exerts on the male connector terminal 110.

In this situation, since the lance portion 311*a* obliquely extending from the partition wall 311 makes engagement with the projection 222*b* of the second spring support portion 222, the direction in which the lance portion 311*a* is inclined changes due to the resilient deformation of the lance portion 311*a* to a direction in which the lance portion 311*a* is open relative to an inner wall of the terminal storage room R, and hence, the lance portion 311*a* at a distal end thereof follows the movement of the terminal main body 20*a*. Thus, it is possible to prevent the lance portion 311*a* at a distal end thereof from being disengaged from the projection 222*b*.

The lance portion 311*a* may be designed to resiliently compress a rear surface of the second spring support portion 222, in which case, the lance portion 311*a* follows the movement of the terminal main body 20*a* by virtue of the resilient force thereof, and hence, it is possible to prevent the lance portion 311*a* at a distal end thereof from being disengaged from the projection 222*b*.

Figure 16:
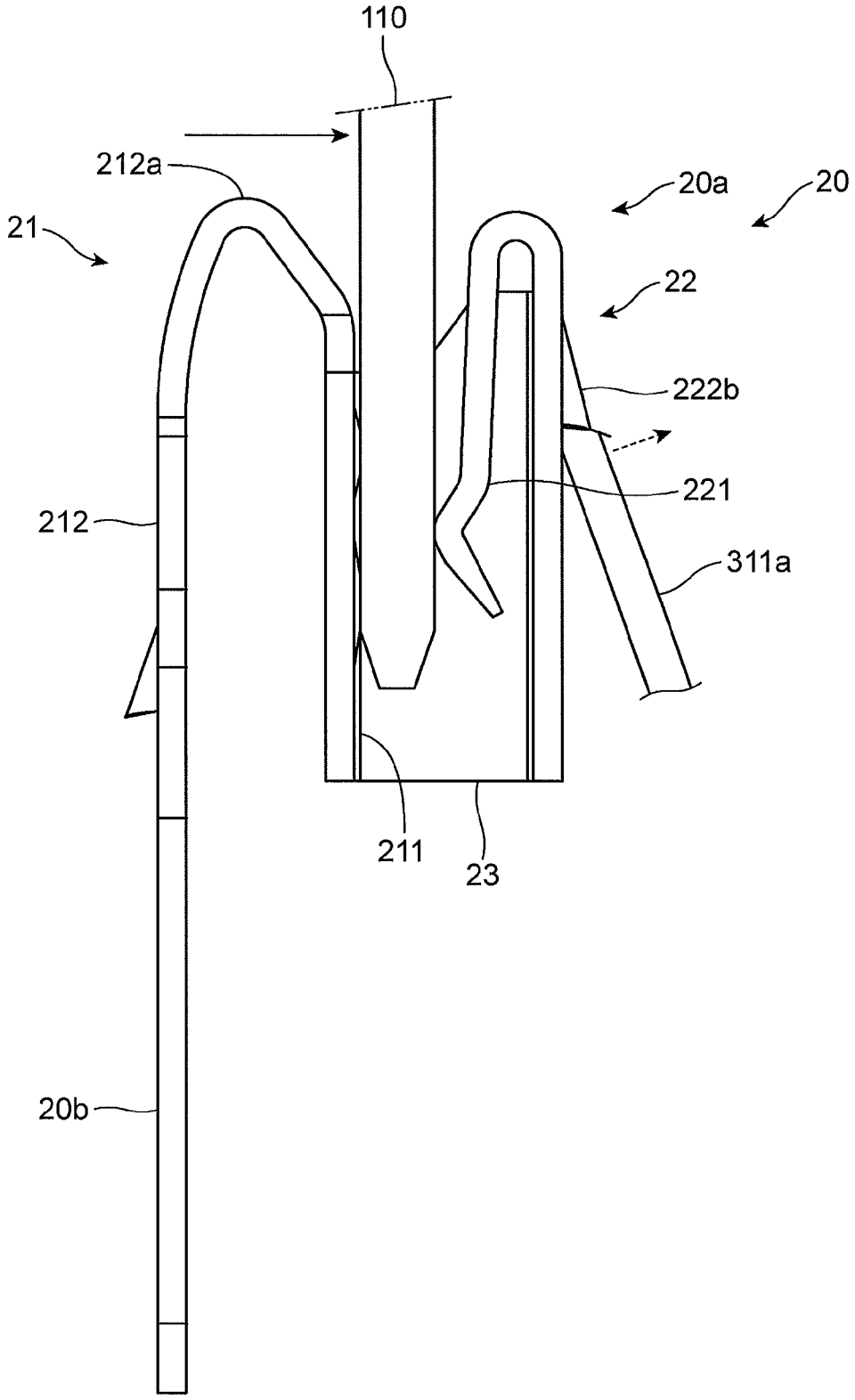
FIG. 16 illustrates that a male connector terminal inserted into the connector terminal illustrated in FIG. 10 horizontally deflects toward the second spring portion.

As illustrated in FIG. 16, if the male connector terminal 110 deflects towards the second spring portion 221, the second spring portion 221 is compressed due to the deflection of the male connector terminal 110, and the second spring portion 211 inclines more obliquely, resulting in that a space between the second spring portion 221 and the first spring portion 211 is caused to expand. However, since the first spring portion 211 and the second spring support portion 222 are connected at sides thereof to each other through the joint portion 23, as mentioned above, the first spring portion 211 is drawn towards the second spring support portion 222. Consequently, it is possible to move the first spring portion 211 and the second spring portion 221 to a position to which the male connector terminal 110 has moved, since the resilient portion 212*a* is resiliently open, maintaining that the terminal main body 20*a* and the male connector terminal 110 contact each other. Thus, since a space between the first spring portion 211 and the second spring support portion 221 is kept constant, it is possible to maintain a contact pressure which the second spring portion 221 exerts on the male connector terminal 110 by virtue of a resilient reaction force thereof.

As mentioned above, since the lance portion 311*a* obliquely extending from the partition wall 311 makes engagement with the projection 222*b* of the second spring support portion 222, the lance portion 311*a* upwardly supports the second spring support portion 222 to thereby prevent the second spring support portion 222 from inclining. Furthermore, since the lance portion 311*a* is designed to compress the second spring support portion 222, the lance portion 311*a* prevents the second spring support portion 222 from inclining. Accordingly, if the male connector terminal 110 moves towards the second spring portion 221 with the housing 30 not including the lance portion 311*a*, the first spring support portion 212 would be deformed at an upper portion thereof, and the terminal main body 20*a* inclines toward the second spring support portion 222, resulting in that a contact pressure between the male connector terminal 110 and the second spring portion 221 would be increased, and that a contact pressure between the male connector terminal 110 and the first spring portion 211 would be decreased. However, since the lance portion 311*a* prevents the second spring support portion 222 from outwardly inclining about a bottom of the second spring support portion 222, a contact pressure between the first spring portion 211 and the second spring portion 221 can be maintained. Thus, it is possible to prevent reduction in contact reliability between the terminal main body 20*a* and the male connector terminal 110.

As mentioned above, even if a positional relation between the printed circuit boards P1 and P2 were deflected due to oscillation, so that the male connector terminal 110 were deflected, the terminal main body 20*a* could swing and follow the deflection, maintaining a contact pressure which the first spring portion 211 and the second spring portion 221 exert on the male connector terminal 110. Thus, it is possible to avoid reduction in contact reliability between the male connector terminal 110 and the connector terminal 20.

As illustrated in FIG. 9, the second spring support portion 222 is designed to include the projection 222*b* with which the top portion 311*b* of the lance portion 311*a* makes engagement. Therefore, even if the terminal main body 20*a* oscillates, the lance portion 311*a* is able to support the second spring support portion 222 at the top portion 311*b* thereof without being disengaged from the second spring support portion 222.

Furthermore, since the abutment surface 311*c* makes surface contact with a rear surface of the second spring support portion 222, and corners of the lance portion 311*a* make abutment with a rear surface of the second spring support portion 222, it is possible to prevent a tension force from concentrating on the corners of the lance portion 311*a* to thereby damage the corners. In addition, since the lance portion 311*a* makes abutment at the abutment surface 311*c* thereof with a rear surface of the second spring support portion 222, the abutment surface 311*c* makes a frictional surface to a rear surface of the second spring support portion 222, ensuring that the lance portion 311*a* surely supports a rear surface of the second spring support portion 222.

Furthermore, since the abutment surface 311*d* has an inclination angle determined in accordance with the same of the inclined surface 222*d*, the lance portion 311*a* can surely make engagement with the projection 222*b*, and the lance portion 311*a* is hard to be disengaged at a distal end thereof from the inclined surface 222*d* of the projection 222*b*.

Figure 4:
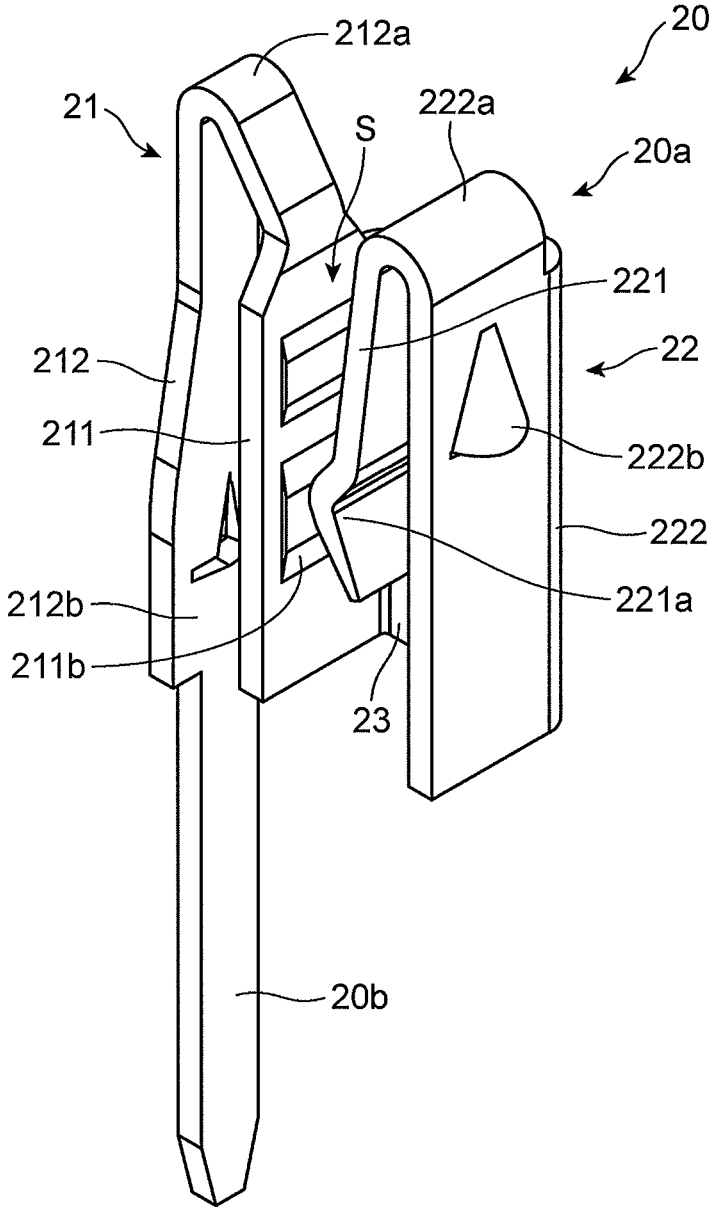
FIG. 4 is a perspective view of the connector terminal used in the electric connector illustrated in FIG. 1, viewed in a direction of the second spring support portion.
Figure 5:
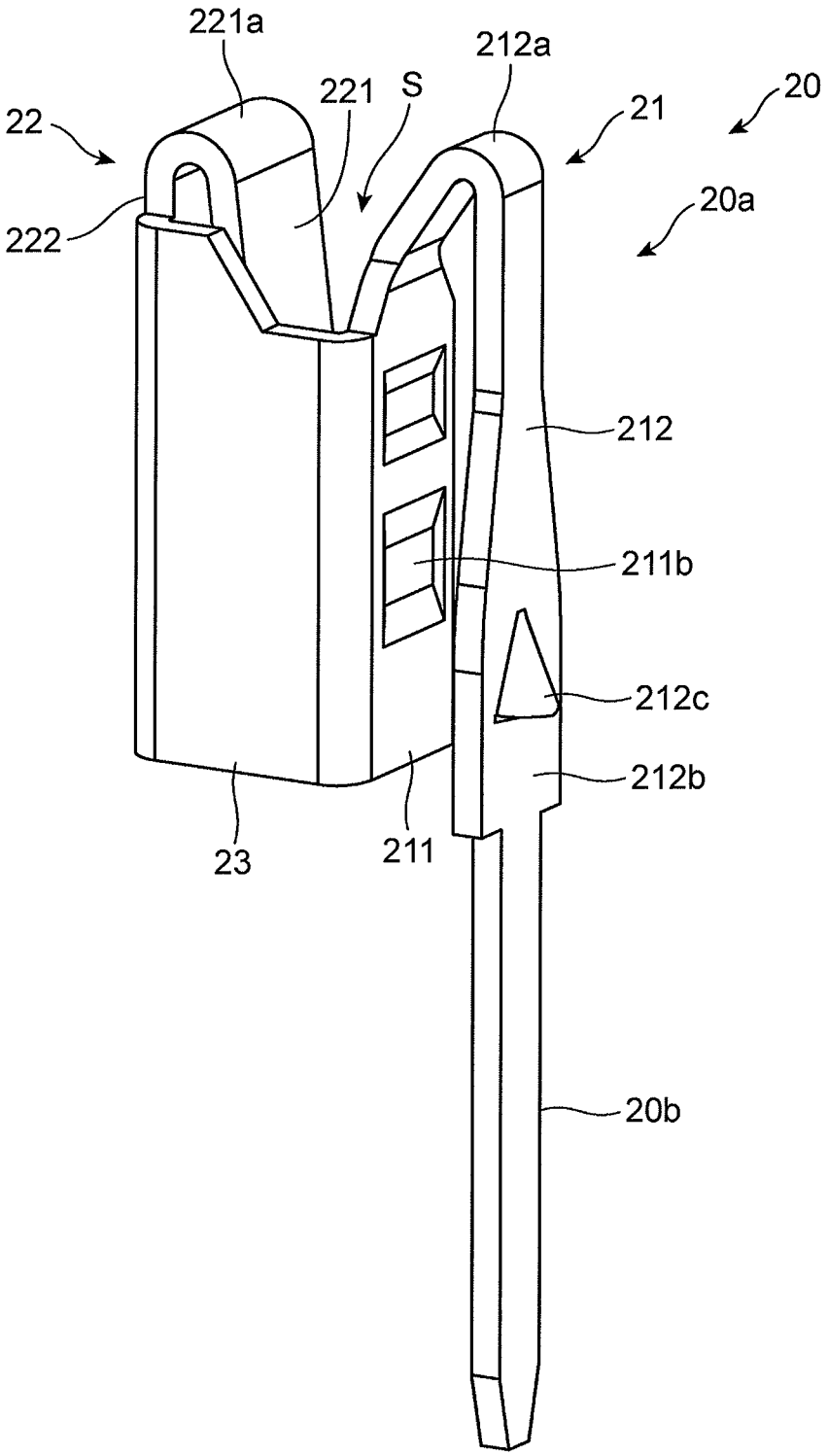
FIG. 5 is a perspective view of the connector terminal illustrated in FIG. 4, viewed in a direction of the joint portion.
Figure 6:
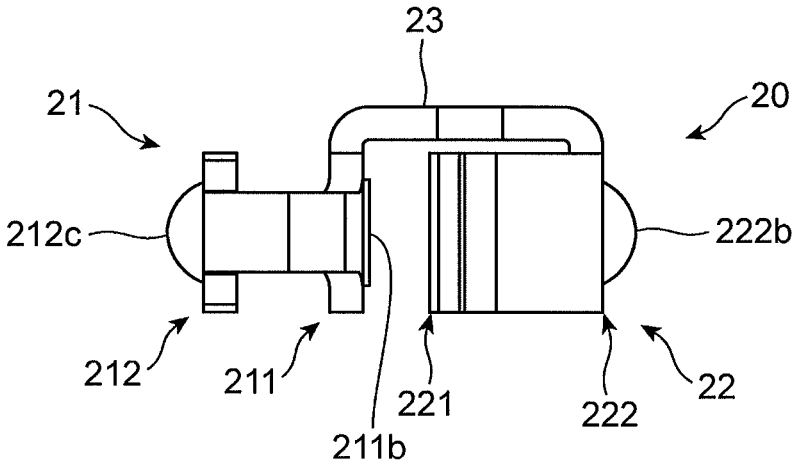
FIG. 6 is a plan view of the connector terminal illustrated in FIG. 4.
Figure 7:
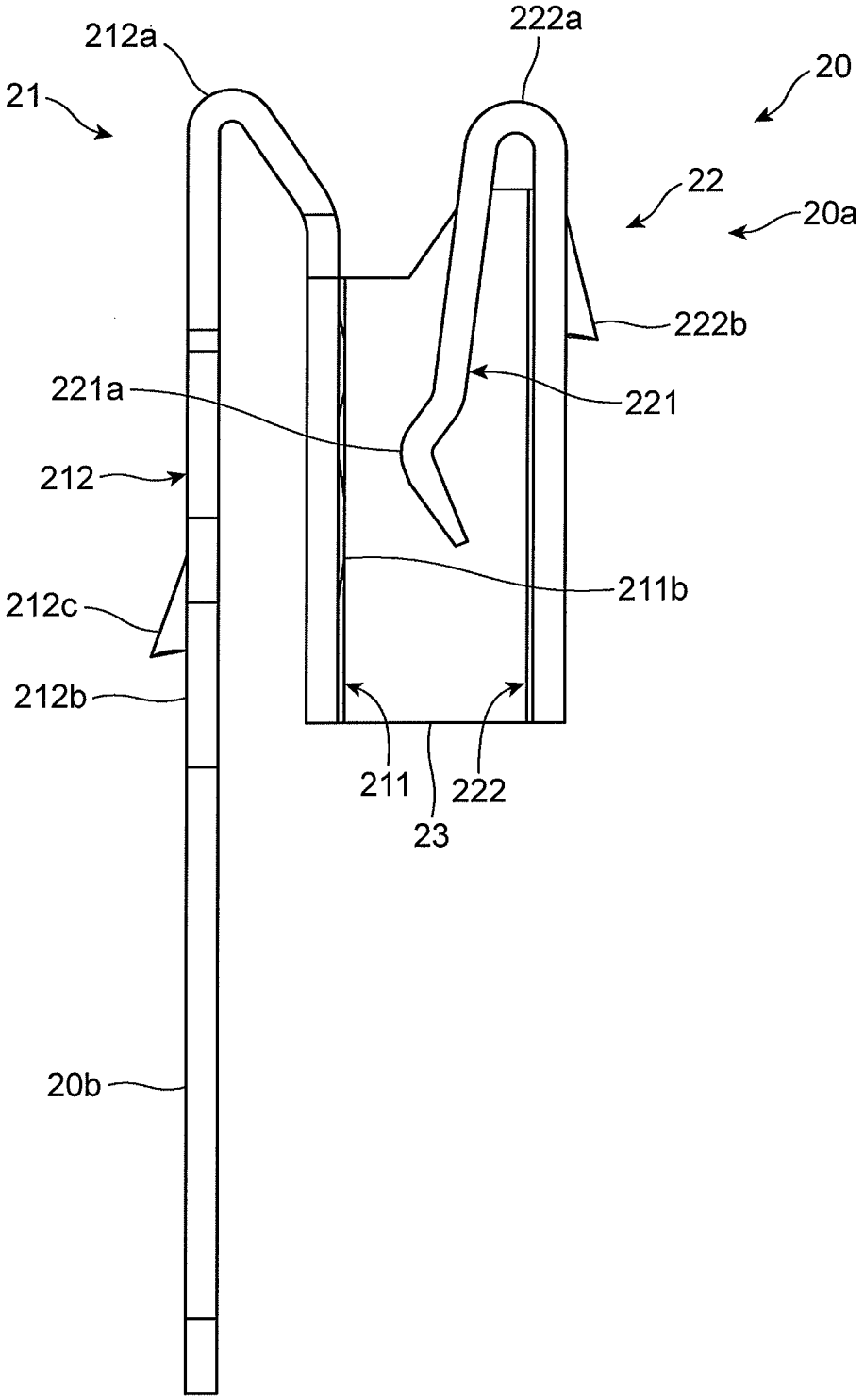
FIG. 7 is a front view of the connector terminal illustrated in FIG. 4.

As illustrated in FIG. 4, since the first spring portion 211 is designed to have at least one projection 211*b* making contact with one side of the male connector terminal 110, and the second spring portion 221 includes at a distal end thereof the contact 221*a* bent substantially V-shaped, a contact pressure can be concentrated on both the projection 211*b* and the contact 221*a*, ensuring that the male connector terminal 110 can be sandwiched between the first spring portion 211 and the spring portion 221 under a sufficient contact pressure.

Though the lance portion 311*a* supports the projection 222*b* located at an upper portion of the second spring support portion 222 in the first embodiment, as illustrated in FIG. 14, the lance portion 311*a* may be designed to support the connector terminal 20 at a portion other than the projection 222*b*, if the lance portion 311*a* supports the connector terminal 20 at an outer surface to thereby prevent the connector terminal 20 from inclining. For instance, the lance portion 311*a* may be designed to support a bottom of the second spring support portion 222 or an outer surface (a surface of the joint portion 23 located opposite to the insertion space S) of the joint portion 23. However, in the case that the lance portion 311*a* supports a bottom of the second spring support portion 222, the lance portion 311*a* has to have a length downwardly under the terminal main body 20*a*, and hence, the connector terminal 20 has to have an increased height. In the case that the lance portion 311*a* supports an outer surface of the joint portion 23, a pitch between the adjacent connector terminals 20 has to be increased. Thus, it is preferable that the lance portion 311*a* supports the projection 222*b* of the second spring support portion 222.

Second Embodiment

The female electric connector in accordance with the second embodiment of the present invention is explained hereinbelow with reference to the drawings. Parts or elements in FIGS. 17 to 19 that correspond to those illustrated in FIGS. 4 to 7 and 14 have been provided with the same reference numerals, and will not be explained.

Figure 17:
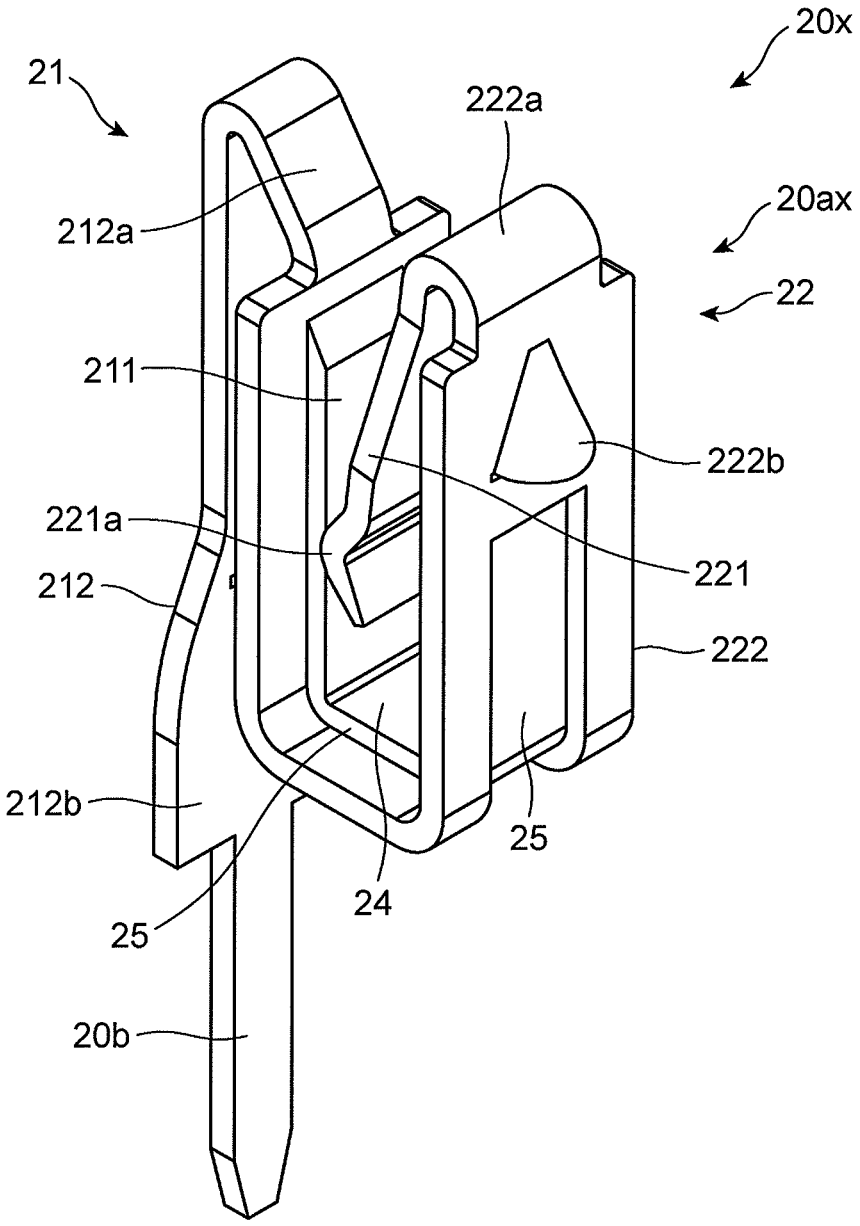
FIG. 17 is a perspective view of the connector terminal in accordance with the second embodiment, viewed in a direction of the second spring support portion.
Figure 18:
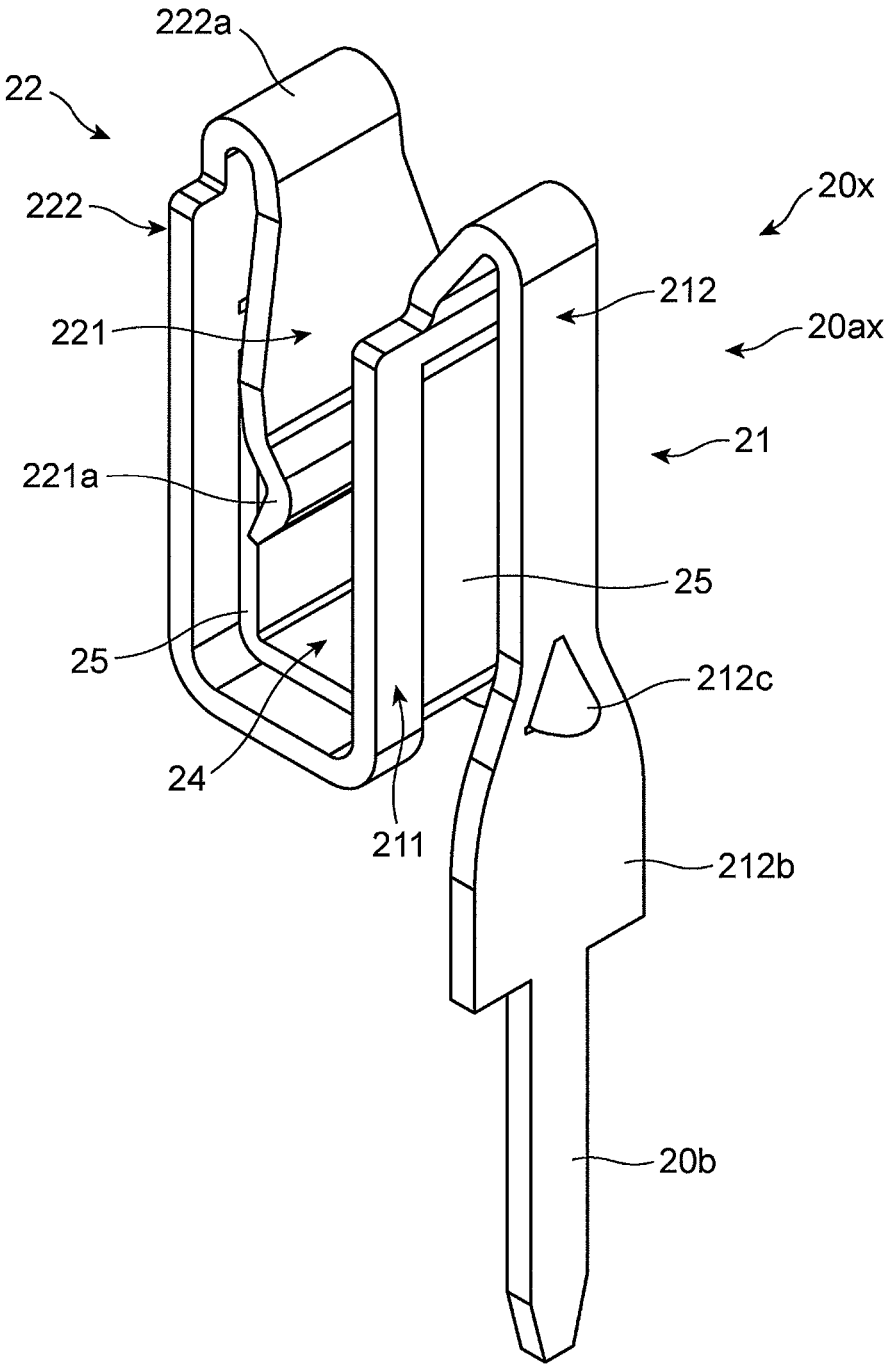
FIG. 18 is a perspective view of the connector terminal illustrated in FIG. 17, viewed in a direction of the first spring support portion.
Figure 19:
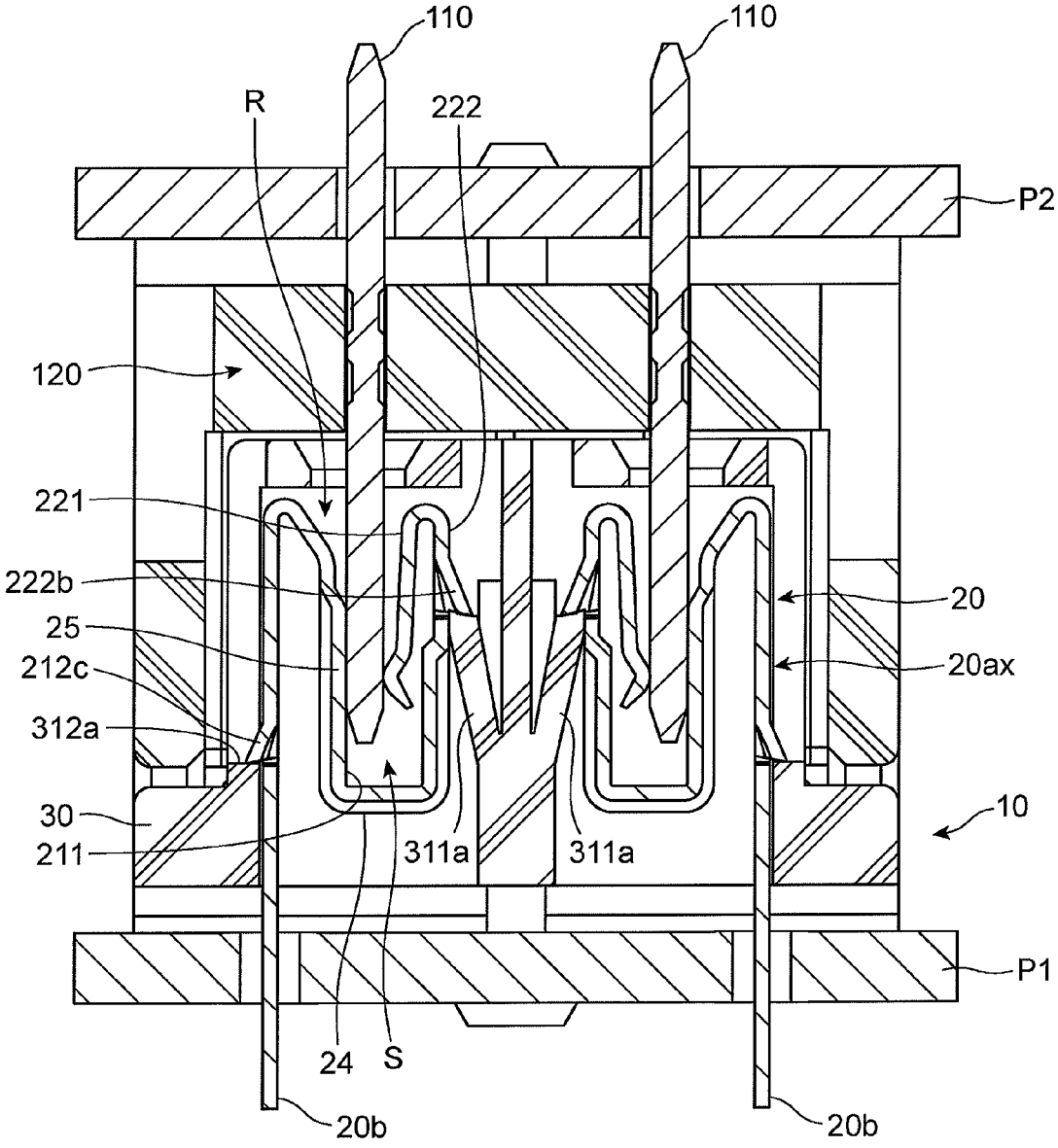
FIG. 19 is a cross-sectional view of the female electric connector housing therein the connector terminal illustrated in FIG. 17, and the male electric connector, being fit with each other.
Figure 20:
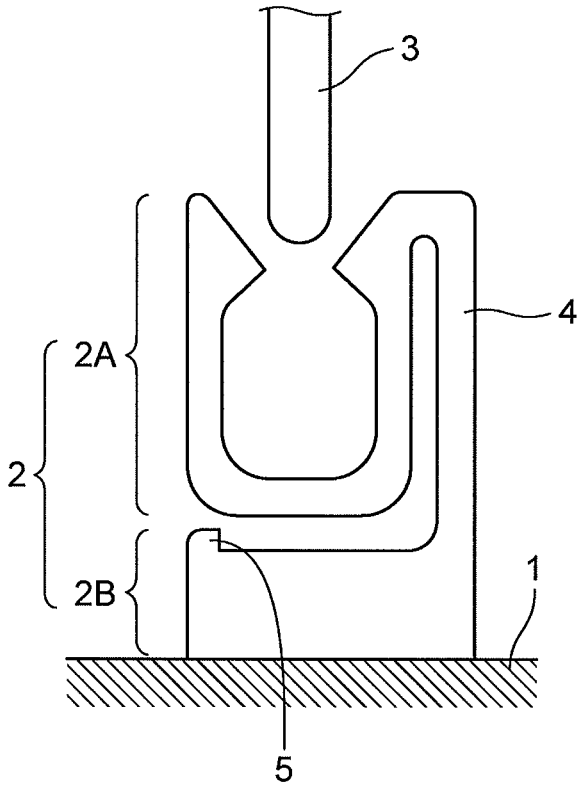
FIG. 20 PRIOR ART
FIG. 20 is a front view of the conventional electric connector.

As illustrated in FIGS. 17 to 19, a connector terminal 20X includes a terminal main body 20*a*X including a joint portion 24 connecting a bottom (a lower end) of the first spring portion 211 and a bottom (a lower end) of the second spring support portion 222 to each other, and a stepped portion 25 formed over the first spring portion 211, the joint portion 24 and the second spring support portion 222 for the purpose of avoiding the first spring portion 211, the joint portion 24 and the second spring support portion 222 from being deformed. The joint portion 24 acts as a space-limiter for limiting a space between the first spring portion 211 and the second spring support portion 222.

By forming the stepped portion 25 by beading, two stepped portions each including a raised surface and a recessed surface can be formed in a single step over the first spring portion 211, the joint portion 24, and the second spring support portion 222. Though the stepped portion 25 of the connector terminal 20X illustrated in FIGS. 17 and 18 has a trapezoidal cross-section, the stepped portion 25 may be designed to have a semi-circular cross-section.

Since the stepped portion 25 enhances the rigidity of the first spring portion 211, the joint portion 24 and the second spring support portion 222, which are substantially U-shaped, the first spring portion 211 and the second spring support portion 222 are not prone to be open in a direction away from each other. Thus, since a contact pressure which the second spring portion 221 exerts on the male connector terminal 110 by virtue of a resilient reaction force thereof can be maintained, it is possible to avoid deterioration in contact reliability between the connector terminal 20X and the male connector terminal 110.

Furthermore, since the terminal main body 20*a*X is movable relative to the resilient portion 212*a*, similarly to the connector terminal 20 in accordance with the first embodiment, the resilient portion 212*a* elastically deforms to be closed or open in dependence on the deflection of the terminal main body 20*a*X to thereby be able to cause the terminal main body 20*a*X to follow the deflection of the male connector terminal 110, maintaining a contact pressure which the terminal main body 20*a*X exerts on the male connector terminal 110.

As mentioned above, even if a positional relation between the printed circuit boards P1 and P2 were deflected due to oscillation, and thus, so that the male connector terminal 110 were deflected, the terminal main body 20*a*X could swing and follow the deflection at its entirety, maintaining a contact pressure which the first spring portion 211 and the second spring portion 221 exert on the male connector terminal 110. Thus, it is possible to avoid deterioration in contact reliability between the male connector terminal 110 and the connector terminal 20X.

Furthermore, similarly to the connector terminal 20 in accordance with the first embodiment, since the projection 222*b* of the second spring support portion 222 makes engagement with the lance portion 311*a*, the lance portion 311*a* prevents the second spring support portion 222 from inclining, maintaining a contact pressure which the first spring portion 211 and the second spring portion 221 exert on the male connector terminal 110. Thus, it is possible to avoid deterioration in contact reliability between the male connector terminal 110 and the terminal connector terminal 20*a*X.

Since a portion of the stepped portion 25 formed in the first spring portion 211 has the same function as that of the projection 211*b* (see FIG. 4) of the first spring portion 211, it is possible to omit to newly form the projection 211*b* making contact with the male connector terminal 110, by forming the stepped portion 25 in the first spring portion 211.

Though the stepped portion 25 in the second embodiment is formed by beading the insertion space S into which the male connector terminal 110 is inserted, there may be formed a rib over the first spring portion 211, the joint portion 24, and the second spring support portion 222 in place of the stepped portion 25.

The electric connectors 10 in accordance with the first and second embodiments have been explained above. The male and female electric connectors in the first and second embodiments are designed to electrically connect two printed circuit boards to each other, but it should be noted that the male and female electric connectors may be connected to cables or anything else.

INDUSTRIAL APPLICABILITY

The electric connector in accordance with the present invention can be broadly employed in fields such as electric, electronic and automobile industries, as a connector to be used for electric and electronic parts and to be fit into a printed circuit board, or a connector to be mounted in an automobile.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2012-182753 filed on Aug. 21, 2012 including specification, claims, drawings and summary is incorporated herein by reference in its entirety.

What is claimed is:

1. An electric connector comprising:

a connector terminal into which a male connector terminal of a male electric connector is to be inserted; and a housing including a terminal storage room in which said connector terminal is housed, said housing including a support supporting said connector terminal at at least one of an outer surface and a bottom of said connector terminal when said male connector terminal is inserted into said terminal storage room for preventing said connector terminal from inclining;

wherein said connector terminal includes a terminal main body and a connector portion, said terminal main body including:

a first spring portion contacting said male connector terminal;

a first spring support portion supporting said first spring portion;

a second spring portion contacting said male connector terminal;

a second spring support portion supporting said second spring portion; and a space-limiter limiting expansion of a space between said first spring portion and said second spring support portion;

wherein said connector portion is formed at said first spring support portion of said terminal main body; and wherein said support supports said second spring support portion of said terminal main body.

2. The electric connector as set forth in claim 1, wherein said support extends from an inner wall of said terminal storage room, and a distal end of said support abuts against an outer surface of said connector terminal.

3. The electric connector as set forth in claim 2, wherein said support has a distal end having an abutment surface through which said support contacts an outer surface of said connector terminal.

4. The electric connector as set forth in claim 2, wherein said support abuts an outer surface of said connector terminal in an inclined condition.

5. The electric connector as set forth in claim 2, wherein said connector terminal includes a projection engaging a distal end of said support.

6. The electric connector as set forth in claim 5, wherein said projection has an inclined surface extending from said connector terminal at an acute angle relative to a direction in which said male connector terminal is inserted into said connector terminal, and has a distal end having an inclined surface abutting said support, said inclined surface being inclining relative to said direction at 90 degrees or an obtuse angle.

7. The electric connector as set forth in claim 6, wherein said support has an abutment surface abutting said inclined surface of said projection.

8. The electric connector as set forth in claim 1, wherein said space-limiter comprises a joint portion connecting a side of said first spring portion with a side of said second spring support portion.

9. The electric connector as set forth in claim 1, wherein said space-limiter comprises:

a joint portion connecting a lower end of said first spring portion with a lower end of said second spring support portion; and a stepped portion extending over said first spring portion, said joint portion, and said second spring support portion.

10. The electric connector as set forth in claim 1, wherein said support is made of an elastically deformable material.

* * * * *